US007987798B2

(12) United States Patent
Kim

(10) Patent No.: US 7,987,798 B2
(45) Date of Patent: Aug. 2, 2011

(54) PALLET MEMBERS

(75) Inventor: Seung Ki Kim, Anyang-si (KR)

(73) Assignee: Alpallet Co., Ltd., Gyeonggi-do (KR)

( * ) Notice: Subject to any disclaimer, the term of this patent is extended or adjusted under 35 U.S.C. 154(b) by 755 days.

(21) Appl. No.: 11/813,850

(22) PCT Filed: Jul. 27, 2005

(86) PCT No.: PCT/KR2005/002442

§ 371 (c)(1),
(2), (4) Date: May 6, 2008

(87) PCT Pub. No.: WO2006/075835

PCT Pub. Date: Jul. 20, 2006

(65) Prior Publication Data

US 2009/0025615 A1 Jan. 29, 2009

(30) Foreign Application Priority Data

Jan. 15, 2005 (KR) ..... 10-2005-0004014

(51) Int. Cl.
*B65D 19/00* (2006.01)

(52) U.S. Cl. ..... 108/56.1; 108/51.11; 108/57.32

(58) Field of Classification Search ..... 108/51.11, 108/56.1, 56.3, 52.1, 57.18, 57.21, 57.22, 108/57.23, 57.29, 57.32, 57.33, 51.3; 248/346.02; 206/386, 600, 533

See application file for complete search history.

(56) References Cited

U.S. PATENT DOCUMENTS

| | | | | |
|---|---|---|---|---|
| 1,772,732 | A * | 8/1930 | Romine | 108/57.21 |
| 1,842,617 | A * | 1/1932 | Lupton | 108/51.11 |
| 2,152,086 | A * | 3/1939 | Powell | 108/57.1 |
| 2,692,107 | A * | 10/1954 | De Ridder et al. | 108/57.17 |
| 3,581,680 | A * | 6/1971 | Fleming et al. | 108/57.18 |
| 3,616,766 | A * | 11/1971 | Weiss | 108/57.18 |
| 4,145,976 | A * | 3/1979 | Svirklys | 108/56.1 |
| 4,485,744 | A | 12/1984 | Umemura et al. | |
| 5,367,960 | A * | 11/1994 | Schleicher | 108/57.32 |
| 5,460,103 | A | 10/1995 | Dunn et al. | |
| 6,766,749 | B2 * | 7/2004 | Lacabanne | 108/56.3 |
| 6,938,558 | B1 * | 9/2005 | Peres | 108/56.3 |
| 2009/0025615 | A1 * | 1/2009 | Kim | 108/57.18 |

FOREIGN PATENT DOCUMENTS

| | | |
|---|---|---|
| DE | 297 14 831 | 10/1997 |
| JP | 2004-359327 | 12/2004 |
| KR | 20-0334246 | 11/2003 |
| KR | 20-0338716 | 1/2004 |

* cited by examiner

*Primary Examiner* — José V Chen

(74) *Attorney, Agent, or Firm* — Merchant & Gould P.C.

(57) ABSTRACT

The pallet includes a plurality of supporting members, a plurality of upper plate members placed parallel with one another on and across the supporting members, and a pair of prop members placed at both ends of a bottom surface of each of the support members. Each of the prop members are constructed such that the outer wall thereof has the same height as both sidewalls accommodated in grooves of the supporting members and the inner wall thereof has a groove into which the body of the supporting member is to be inserted, thereby, preventing possible accidents of injuries and damages by keeping dangerous sharp cut edges of the respective members from being exposed.

28 Claims, 5 Drawing Sheets

[Fig. 1]
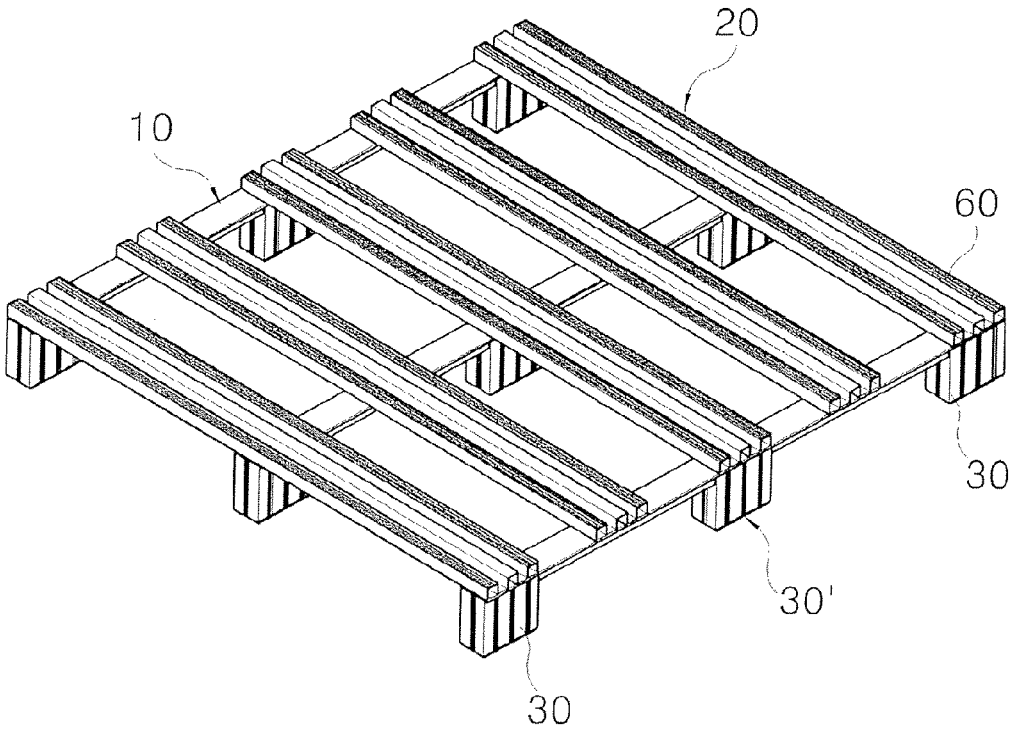

[Fig. 2]
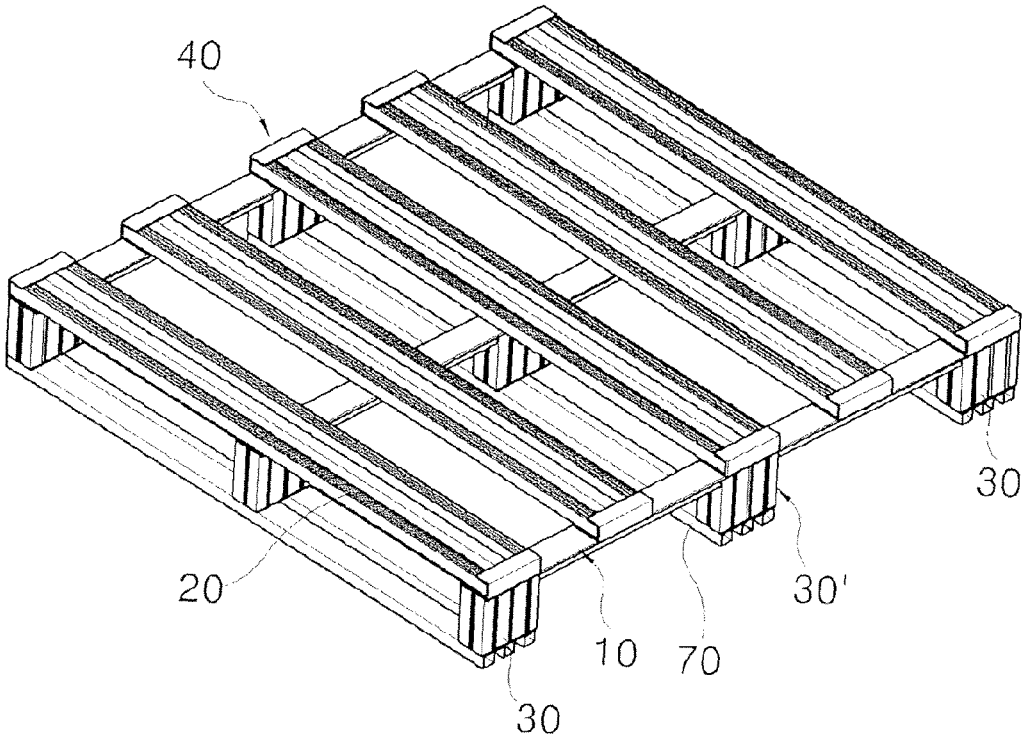

[Fig. 3]
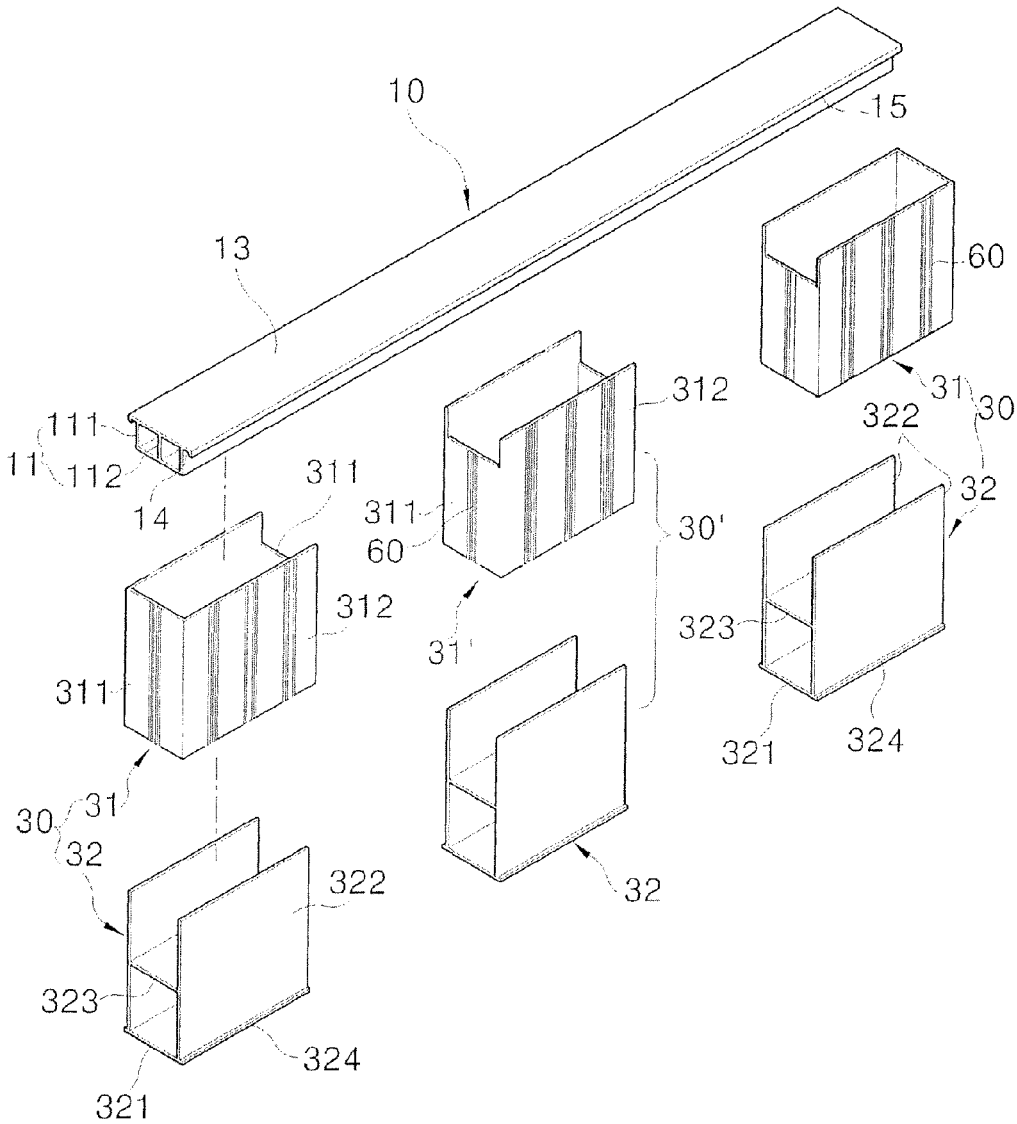

[Fig. 4]
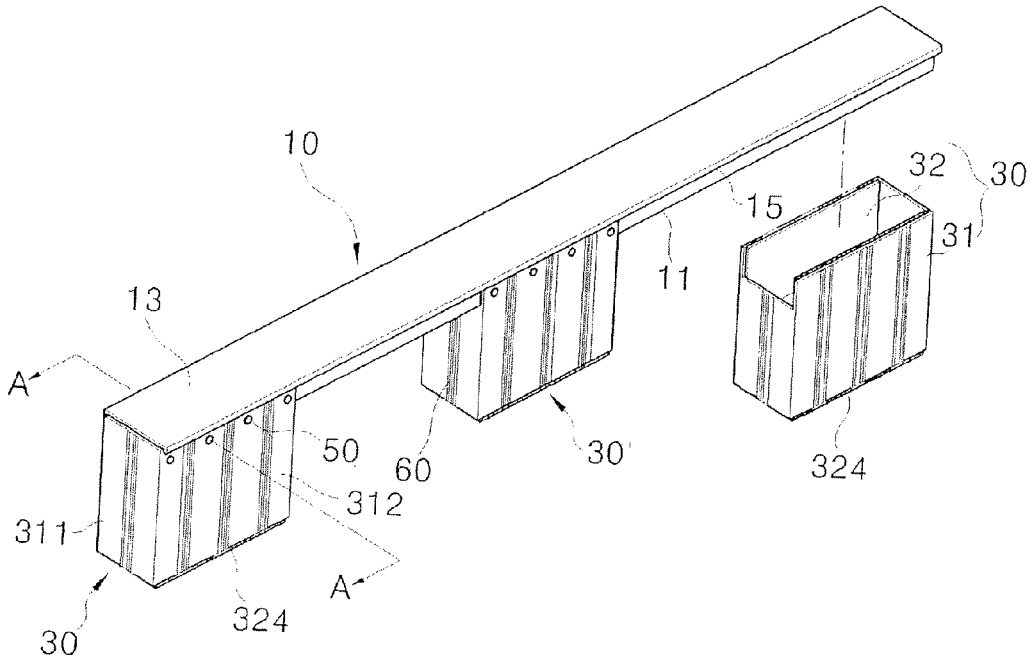

[Fig. 5]
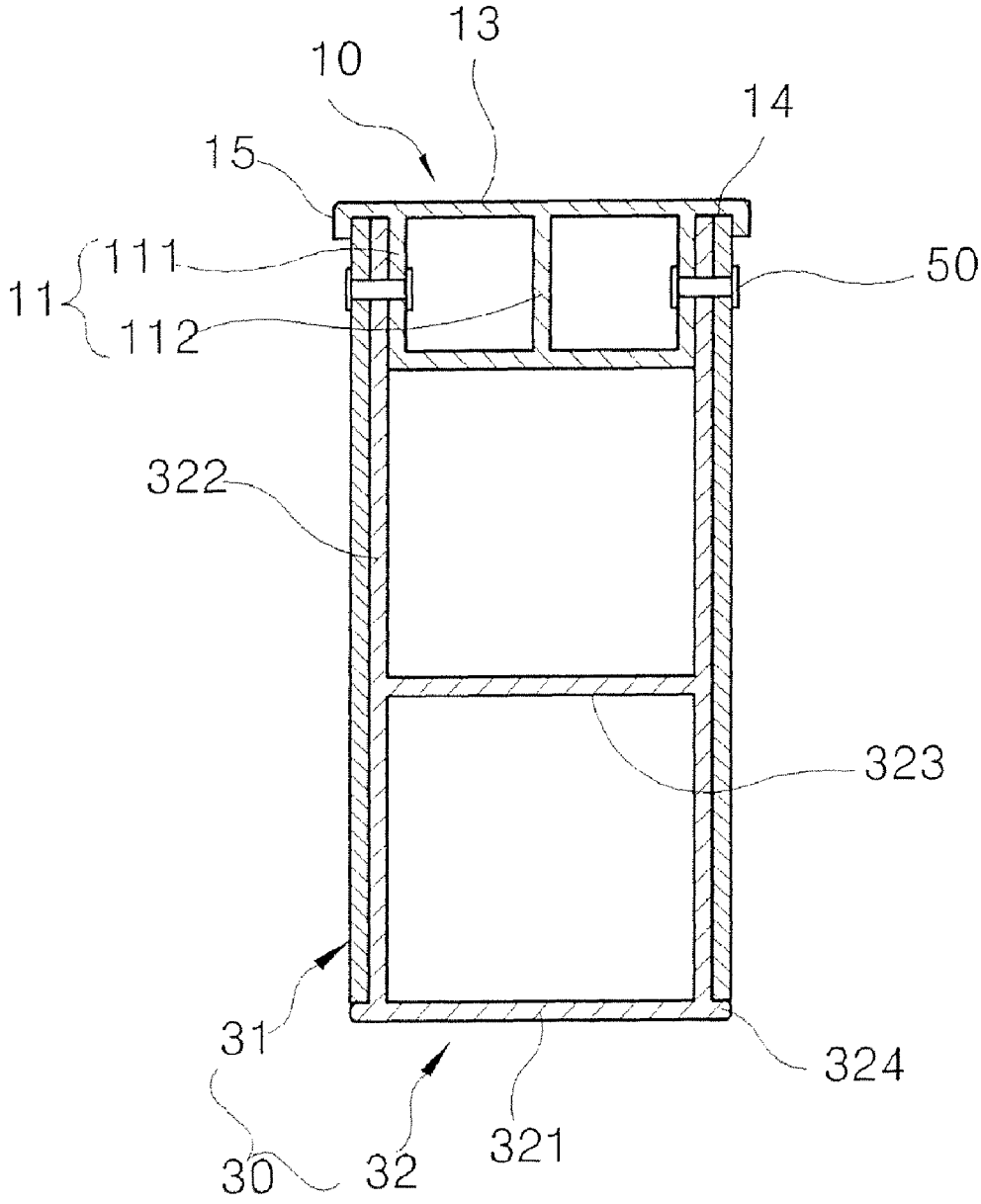

PALLET MEMBERS

TECHNICAL FIELD

The present invention relates to a pallet made of a plastics or metal material such as aluminum adopted or used for the solidity and durability thereof, and more particularly, to a pallet in which sharp cut edges of the members are prevented from being exposed.

BACKGROUND ART

Generally, pallets have been widely used to stack bulky and heavy goods for lifting and transporting, especially by forklift trucks. Among various kinds of pallets, known are robust and durable pallets comprising supporting members, upper plate members and prop members, which are formed by cutting extrusion-molded basic materials of different shapes into desired lengths of pieces.

Since the pieces or members obtained as above have sharp cut edges, the pallets made of such members also have cut edges directly exposed to the danger of harming the workers involved and/or damaging the workers' clothes or other objects touched by them.

To lift a pallet with goods stacked thereon, forks of a forklift truck should be inserted into spaces between prop members of the pallet. However, even a driver skilled in operating the truck may have difficulties in accurate insertion of the forks. Thus, the prop members, among others, are liable to be deformed or damaged, thereby shortening the life of the pallet itself, if the forks strike against the prop members while being inserted into the spaces between the prop members.

DISCLOSURE OF INVENTION

Technical Problem

Accordingly, the present invention is conceived to solve the problems in the prior art as above. An object of the invention is to provide a pallet which may reduce possible injuries to the workers or damages to the objects involved in using, operating or keeping in custody thereof with or without goods stacked thereon.

Another object of the present invention is to provide a pallet with improved robustness or solidity.

Technical Solution

The objects of the present invention are achieved by making cut edges of respective members of a pallet to be buried in or hidden by a cover or the like and by constructing prop members to have a reinforced double structure.

BRIEF DESCRIPTION OF THE DRAWINGS

FIGS. 1 and 2 are perspective views of a pallet according to an embodiment of the present invention and a modification thereof;

FIG. 3 is an exploded perspective view of a supporting member and prop members shown in FIG. 1;

FIG. 4 is a partial exploded perspective view showing a coupled state of the supporting member and the prop members shown in FIG. 1; and FIG. 5 is a sectional view along the line A-A of FIG. 4.

BEST MODE FOR CARRYING OUT THE INVENTION

Hereinafter, pallets according to the preferred embodiments of the present invention will be described in detail with reference to the accompanying drawings.

FIG. 1 is a perspective view of a pallet according to an embodiment of the present invention; FIGS. 3 and 4 are overall and partial exploded views of the assembly of a supporting member and prop members in FIG. 1, respectively; and FIG. 5 is a sectional view along the line A-A of FIG. 4.

In FIG. 1, the pallet comprises three supporting members 10 arranged parallel at a certain interval with one another, five upper plate members 20 placed parallel at a certain interval with one another, across and on the supporting members 10, and a pair of prop members 30 and an auxiliary prop member 30' fixed on both ends and the central portion of the bottom surface of each of the supporting members, respectively.

The supporting members 10 are formed into a rectangular tubular shape and comprises a body 11 having opposite walls 111 and a reinforcing wall 112 therebetween and a roof portion 15 with opposite wings 13 provided with a downward projection for defining a longitudinal groove 14.

The upper plate members 20 may have a cross section in the form of

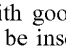

or

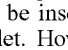

A conventional upper plate members including those disclosed in the Korean Utility Model Registration Nos. 334246 and 338716 in the name of the applicant may also be used.

Further, both ends of the upper plate member 20 are covered by guards 40 which have a cross section in the form of

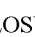

or to prevent sharp cut edges thereof from being exposed to the outside.

The prop member 30 comprises a body 31 and a reinforcement 32 with a size to be coupled within the body 31, and the auxiliary prop member 30' also comprises a body 31' and a reinforcement 32, as the prop members 30.

The body 31 may be made by cutting an elongated tubular material, extruded to have integral inner and outer walls 311 and sidewalls 312, into a desired length. Two bodies 31 are attached under the both ends of the supporting member 10. In the body 31 of the prop member, the inner wall 311 has a rectangular groove made by cutting away the upper portion thereof in proportion to the height of the wall 111 of the supporting member 10 so as to receive the body 11 of the supporting member therein. In the body 31' of the auxiliary prop member 30' to be attached under the central portion of the supporting member 10, both inner and outer walls 311 thereof have a rectangular groove formed by cutting away the upper portions thereof to receive the body 11 of the supporting member in the same manner as described above for the prop member 30.

The body 11 of the supporting member 10 constructed as above is accommodated and engaged in the upper space of the bodies 31 and 31', while the bottom portion of the body 11 is seated on the upper ends of the inner and outer walls 311 forming the bottom of the grooves.

The front and rear ends of the supporting member 10 abut on upper ends of the outer walls 311 of the bodies 31 of the prop members, while upper ends of the sidewalls 312 thereof are placed in the longitudinal grooves 14 of the supporting member 10 and then covered with the wings 13. Thus, sharp cut edges at the both ends of the supporting member 10 and the upper ends of the sidewalls of the bodies 31 of the prop members 30 are covered not to be exposed so that accidents of injuries or damages due to such sharp cut edges may be prevented. This is also true of the auxiliary prop member 30'.

Each of the reinforcements 32 comprises opposite sidewalls 322 with a transverse partition 323 formed therebetween, and a bottom portion 321 with extensions 324 formed outwardly.

The reinforcement 32 may be made by cutting an elongated tubular body, extruded to have a sectional shape of "日", into a desired length. The length of the reinforcement is around the same as the distance between the inner and outer walls 311 of the body 31 or 31', and the distance between outer surfaces of the both sidewalls 322 is almost the same as that between inner surfaces of the both sidewalls 312 of the body 31.

Thus, upper ends of the sidewalls 312 and 322 with the same height are flush with each other, when the reinforcement 32 is coupled into the body 31. Walls 111 of the body 11 are placed in the space between the sidewalls of the reinforcement, as the body 11 of the supporting member 10 is fitted into the prop member 30. This is also true of the body 31' of the auxiliary prop member 30'.

Meanwhile, the height of the sidewalls 322 of the reinforcement 32 may be made lower than that of the sidewalls 312 of the body 31 or 31'. In this case, the upper portions of the both sidewalls 312 of the body 31 or 31' are preferably thicker than the other portions thereof such that those portions may be tightly caught in the groove 14.

In this state, the upper ends of the sidewalls 322 of the reinforcement 32 are not exposed to the outside, as they are received within the grooves 14 of the supporting member 10, together with the upper ends of the sidewalls 312 of the body 31 or 31'. At the same time, lower ends of the both sidewalls 312 of the body 31 or 31' are seated on upper surfaces of the extensions 324 of the reinforcement so that they may not be exposed to the outside. Consequently, sharp cut edges of the upper ends of the sidewalls of the reinforcement and the lower ends of the sidewalls of the body are not exposed, thereby preventing accidents of injuries or damages.

Since the prop member 30 has a double structure in which the reinforcement 32 is fitted into the body 31 and the body 11 of the supporting member 10 is mounted in the upper portion of the prop member and the transverse partition 323 is formed at the intermediate portion of the reinforcement, the strength of the prop member is increased so that the prop member may not be easily deformed or damaged, even in the case that a strong impact is applied thereto. Accordingly, the life of the pallet can be prolonged. This is also true of the auxiliary prop member 30'.

However, depending on the size or weight of articles to be stacked on the pallet, the prop member may consist of only the body 31 without the reinforcement. In this case, it is preferred that a cover is attached to the lower opening of the body.

The gaps or intervals between and numbers of supporting members 10, upper plate members 20, prop members 30 and auxiliary prop members 30' are determined in consideration of the sizes or weights of articles to be stacked on the pallet. Coupling portions of the supporting members 10 and the upper plate members 20 are preferably fixed to each other by means of fasteners such as rivets 50.

The auxiliary prop member 30' may be constructed of a tubular body with a closed top face, which may be directly coupled to the bottom surface of the body of the supporting member 10 by means of spot welding, riveting or the like.

Meanwhile, the top surfaces of the upper plate member 20 and the outer surface of the body 31 of the prop member 30 are preferably provided with a plurality of nonslip protrusions 60 to prevent slipperiness of the pallet and sliding of articles stacked on the pallet and to reinforce the strength of the members themselves.

FIG. 2 is a perspective view of a pallet according to a modification of the pallet in FIG. 1, which comprises three supporting members 10, five upper plate members 20, a pair of prop members 30 and an auxiliary prop member 30' combined in the same manner as in the embodiment of FIG. 1, and further three reinforcing members 70 with the same construction as the upper plate members 20 in FIG. 1 fixed to the bottom surfaces of the prop members 30 and the auxiliary prop member 30' respectively.

The pallet in FIG. 2 has the same functions as that in FIG. 1 except that the durability and solidity of the prop members 30 and the auxiliary prop member 30' are improved by the addition of the reinforcing members 70 and detailed description of the pallet in FIG. 2 will, therefore, be not necessary.

The construction of the reinforcing members 70, is not limited to that in FIG. 2, of course.

Although the pallets of the present invention have been described in connection with the preferred embodiments, it is to be noted that the present invention is not limited thereto. For instance, the supporting members 10 may be made without the roof portion and with the wings extending outwardly from the upper ends of the walls.

Moreover, it will be apparent to those skilled in the art that variations, modifications and changes can be made to the embodiments described above without departing from the spirit and scope of the present invention and those variations, modifications and changes fall within the scope of the present invention.

INDUSTRIAL APPLICABILITY

According to the present invention, the pallets are made such that sharp cut edges of the supporting members, upper plate members and prop members are not exposed to the outside. Thus, it is possible to reduce the possible accidents of injuries and damages. Accordingly, there is an advantage in that the pallet can be safely used.

Particularly, with the double structure of the prop members in which the body and the reinforcement are coupled together and the body of the supporting member is coupled to the upper portion of the prop member and the transverse partition is provided at the intermediate portion of the reinforcement, deformation or damage of the pallet can hardly be caused by force of impact thereon. Thus, there is an advantage in that the life of the pallet itself is prevented from being shortened by such impact.

The invention claimed is:

1. A pallet, comprising:

a plurality of supporting members arranged parallel at an interval with one another, wherein each of the plurality of supporting members includes a tubular body, a top surface having an overhang on longitudinal sides of the tubular body, and a downward groove on each side of the tubular body, the downward grooves defined by a downward projection at a distal end of the overhangs;

a plurality of upper plate members arranged parallel at an interval with one another across the top surfaces of the plurality of supporting members; and a plurality of prop members cooperatively attached to a bottom surface of each of the plurality of supporting members, wherein each of the plurality of prop members include:

a body with an open top, inner and outer walls, opposite sidewalls, and a groove formed between the opposite sidewalls and above the inner walls so that a height of the inner walls is less than a height of the opposite sidewalls, wherein upper ends of the opposite sidewalls are received and fitted in corresponding downward grooves of a supporting member, and the groove formed between the opposite sidewalls and above the inner walls of the body is configured to be received and fitted to the tubular body of a supporting member; and a reinforcement with inner and outer walls and opposite sidewalls configured to be engaged within a space defined by the inner and outer walls and opposite sidewalls of the body, and a bottom portion with outward extensions at both sides thereof for engaging and covering lower ends of the opposite sidewalls of the body.

2. The pallet as claimed in claim 1, further comprising at least one auxiliary prop member configured to be attached to the bottom surface of each of the plurality of supporting members and arranged between a pair of prop members.

3. The pallet as claimed in claim 2, wherein the at least one auxiliary prop member comprises a tubular body with a closed top portion, inner and outer walls and opposite sidewalls.

4. The pallet as claimed in claim 2, wherein the at least one auxiliary prop member comprises a body with an open top, inner and outer walls and opposite sidewalls, and opposite grooves at upper ends of the inner and outer walls such that a height of the inner and outer walls are similar and less than a height of the opposite sidewalls, and wherein the opposite grooves at the upper ends of the inner and outer walls are configured to be received and fitted to the tubular body of a supporting member.

5. The pallet as claimed in claim 4, wherein the at least one auxiliary prop member further comprises a reinforcement with inner and outer walls and opposite sidewalls configured to be engaged within a space defined by the inner and outer walls and opposite sidewalls of the body and a bottom portion with outward extensions at both sides thereof configured for engaging and covering lower ends of the opposite sidewalls of the body.

6. The pallet as claimed in claim 1, wherein the height of the opposite sidewalls of the body of a prop member is equal to a height of the opposite sidewalls of a reinforcement.

7. The pallet as claimed in claim 1, wherein the height of the opposite sidewalls of the reinforcement is less than the height of the opposites sidewalls of the body.

8. The pallet as claimed in claim 1, wherein the at least one auxiliary prop member further comprises a reinforcement with inner and outer walls and opposite sidewalls configured to be engaged within a space defined by the inner and outer walls and opposite sidewalls of the body and a bottom portion with outward extensions at both sides thereof for engaging and covering lower ends of the opposite sidewalls of the body.

9. A pallet, comprising:

a plurality of supporting members arranged parallel at an interval with one another, wherein each of the plurality of supporting members have a tubular body shape;

a plurality of upper plate members arranged parallel at an interval with one another across top surfaces of the plurality of supporting members, wherein each of the plurality of the upper plate members have a cross section in the form of ⊓⊓⊓; and a plurality of prop members attached to a bottom surface of each of the plurality of supporting members, wherein each of the plurality of prop members include:

a body with an open top, inner and outer walls, opposite sidewalls, and a groove formed between the opposite sidewalls and above the inner walls such that a height of the inner walls is less than a height of the opposite sidewalls, wherein the groove formed between the opposite sidewalls and above the inner walls of the body is configured to be received and fitted to the tubular body of a supporting member; and the a reinforcement with inner and outer walls and opposite sidewalls configured to be engaged within a space defined by the inner and outer walls and opposite sidewalls of the body, and a bottom portion with outward extensions at both sides thereof for engaging and covering lower ends of the opposite sidewalls of the body.

10. The pallet as claimed in claim 9, wherein opposite ends of each of the plurality of upper plate members are configured to be covered with a guard having a cross section in the form of ⊏ or ⊏.

11. The pallet as claimed in claim 9, wherein lower ends of opposite outer walls of each of the plurality of upper plate members extend inwardly towards an adjacent inner wall so that each of the plurality of upper plate members have a cross section in the form of ⊔⊓⊔.

12. The pallet as claimed in claim 9, wherein each of the plurality of supporting members have opposite downward grooves defined by a downward projection at distal ends, and upper ends of the opposite sidewalls of a prop member are received and coupled in corresponding downward grooves.

13. The pallet as claimed in claim 9, further comprising at least one auxiliary prop member including a tubular body with a closed top portion, inner and outer walls, and opposite sidewalls, wherein the at least one auxiliary prop member is configured to be attached to the bottom surface of each of the plurality of supporting member and arranged between a pair of prop members.

14. The pallet as claimed in claim 9, further comprising at least one auxiliary prop member including a body having an open top, inner and outer walls, opposite sidewalls, and opposite grooves at upper ends of the inner and outer walls such that a height of the inner and outer walls are similar and less than a height of the opposite sidewalls, and wherein the opposite grooves at the upper ends of the inner and outer walls are configured to be received and fitted to the tubular body of a supporting member.

15. The pallet as claimed in claim 14, wherein the at least one auxiliary prop member further comprises a reinforcement with inner and outer walls and opposite sidewalls configured to be engaged within a space defined by the inner and outer walls and opposite sidewalls of the body and a bottom portion with outward extensions at both sides thereof for engaging and covering lower ends of the opposite sidewalls of the body.

16. The pallet as claimed in claim 9, wherein the height of the opposite sidewalls of the body of a prop member is equal to a height of the opposite sidewalls of a reinforcement.

17. The pallet as claimed in claim 9, wherein the height of the opposite sidewalls of the reinforcement is less than the height of the opposite sidewalls of the body.

18. The pallet as claimed in claim 9, wherein the at least one auxiliary prop member further comprises a reinforcement with inner and outer walls and opposite sidewalls configured to be engaged within a space defined by the inner and outer walls and opposite sidewalls of the body and a bottom portion with outward extensions at both sides thereof for engaging and covering lower ends of the opposite sidewalls of the body.

19. A pallet, comprising;

a plurality of supporting members arranged parallel at an interval with one another, wherein each of the plurality of supporting members has a tubular body shape, a top surface having an overhang on longitudinal sides of the tubular body, and opposite downward grooves defined by a downward projection from the overhang of the top surface;

a plurality of upper plate members placed parallel at an interval with one another across the top surfaces of the plurality of supporting members, wherein lower ends of opposite outer walls of each of the plurality upper plate members extend inwardly so that each of the plurality of upper plate members have a cross section in the form of ⊔⊔⊔; and a plurality of prop members attached to a bottom surface of each of the plurality of supporting members, wherein each of the plurality of prop members comprise:

a body with an open top, inner and outer walls, and opposite sidewalls; and a reinforcement including inner and outer walls and opposite sidewalls configured to be engaged within a space defined by the inner and outer walls and opposite sidewalls of the body and a bottom portion with outward extensions at both sides thereof configured for engaging and covering lower ends of the opposite sidewalls of the body.

20. The pallet as claimed in claim 19, wherein opposite ends of each of the plurality of upper plate members are covered with a guard.

21. The pallet as claimed in claim 19, wherein lower ends of opposite outer walls of each of the plurality of upper plate members extend inwardly towards an adjacent inner wall so that each of the plurality of upper plate members have a cross section in the form of ⊔⊔⊔.

22. The pallet as claimed in claim 19, wherein each of the plurality of prop members include a groove formed between the opposite sidewalls and above the inner walls so that a height of the inner walls is less a height of the opposite of the sidewalls, wherein upper ends of the opposite sidewalls are configured to be received and fitted in corresponding downward grooves of a supporting member and the groove formed between the opposite sidewalls and above the inner walls of the body is configured to be received and fitted to the tubular body of a supporting member.

23. The pallet as claimed in claim 19, further comprising at least one auxiliary prop member including a tubular body with a closed top portion, inner and outer walls, and opposite sidewalls, wherein the at least one auxiliary prop member is configured to be attached to the bottom surface of each of the plurality of supporting member and arranged between a pair of prop members.

24. The pallet as claimed in claim 19, further comprising at least one auxiliary prop member including a body having an open top, inner and outer walls, opposite sidewalls, and opposite grooves at upper ends of the inner and outer walls such that a height of the inner and outer walls are similar and less than a height of the opposite sidewalls, and wherein the opposite grooves at the upper ends of the inner and outer walls are configured to be received and fitted to the tubular body of a supporting member.

25. The pallet as claimed in claim 24, wherein the at least one auxiliary prop member further comprises a reinforcement with inner and outer walls and opposite sidewalls configured to be engaged within a space defined by the inner and outer walls and opposite sidewalls of the body and a bottom portion with outward extensions at both sides thereof for engaging and covering lower ends of the opposite sidewalls of the body.

26. The pallet as claimed in claim 19, wherein the height of the opposite sidewalls of the body of a prop member is equal to a height of the opposite sidewalls of a reinforcement.

27. The pallet as claimed in claim 19, wherein the height of the opposite sidewalls of the reinforcement is less than the height of the opposite sidewalls of the body.

28. The pallet as claimed in claim 19, wherein the at least one auxiliary prop member further comprises a reinforcement with inner and outer walls and opposite sidewalls configured to be engaged within a space defined by the inner and outer walls and opposite sidewalls of the body and a bottom portion with outward extensions at both sides thereof for engaging and covering lower ends of the opposite sidewalls of the body.

* * * * *